US005647155A

United States Patent [19]

Hillstrom

[11] Patent Number: 5,647,155

[45] Date of Patent: Jul. 15, 1997

[54] SHEET TENSIONING SYSTEM

[75] Inventor: David U. Hillstrom, Novi, Mich.

[73] Assignee: Marketing Displays, Inc., Farmington Hills, Mich.

[21] Appl. No.: 562,073

[22] Filed: Nov. 22, 1995

[51] Int. Cl.[6] ..... G09F 17/00

[52] U.S. Cl. ..... 40/603; 160/371

[58] Field of Search ..... 40/603, 604; 38/102.91; 160/327, 271; 24/462

[56] References Cited

U.S. PATENT DOCUMENTS

| | | | |
|---|---|---|---|
| 2,335,361 | 11/1943 | Schiller . | |
| 2,708,529 | 5/1955 | Lander et al. . | |
| 2,832,171 | 4/1958 | Batey . | |
| 3,205,628 | 9/1965 | Frisk . | |
| 3,529,653 | 9/1970 | Fey, Jr. . | |
| 3,660,233 | 5/1972 | Dalke et al. . | |
| 4,132,390 | 1/1979 | Pfarr, Jr. . | |
| 4,265,039 | 5/1981 | Brooks . | |
| 4,317,302 | 3/1982 | Von De Linde . | |
| 4,380,880 | 4/1983 | Gandy . | |
| 4,408,433 | 10/1983 | Scherrer . | |
| 4,409,749 | 10/1983 | Hamu . | |
| 4,452,000 | 6/1984 | Gandy | 40/574 |
| 4,539,734 | 9/1985 | Messerschmitt . | |
| 4,542,605 | 9/1985 | Gandy | 40/574 |
| 4,554,754 | 11/1985 | Stilling | 40/603 |
| 4,625,490 | 12/1986 | Baslow . | |
| 4,674,213 | 6/1987 | Keithley | 40/603 |
| 4,674,214 | 6/1987 | Gandy | 40/603 |
| 4,692,847 | 9/1987 | Gandy . | |
| 4,788,806 | 12/1988 | Sease . | |
| 4,802,296 | 2/1989 | Kovalak, Jr. | 40/607 |
| 4,817,317 | 4/1989 | Kovalak, Jr. | 40/603 |
| 4,862,615 | 9/1989 | Hillstrom | 40/603 |
| 4,894,960 | 1/1990 | Hill et al. . | |
| 4,937,961 | 7/1990 | Gandy et al. | 40/603 |
| 4,955,928 | 9/1990 | Tanner | 40/603 |
| 4,980,934 | 1/1991 | Dahowski et al. . | |
| 5,127,177 | 7/1992 | Tanner | 40/603 |
| 5,140,765 | 8/1992 | King | 40/603 |
| 5,230,377 | 7/1993 | Berman . | |
| 5,245,773 | 9/1993 | Snyder | 40/603 |
| 5,245,774 | 9/1993 | Huber | 40/603 |
| 5,301,447 | 4/1994 | Lotter et al. | 40/603 |
| 5,381,324 | 1/1995 | Hillstrom et al. . | |
| 5,398,388 | 3/1995 | Coleman | 24/462 X |

FOREIGN PATENT DOCUMENTS

| | | |
|---|---|---|
| 1251076 | 4/1961 | France . |

*Primary Examiner*—Joanne Silbermann
*Attorney, Agent, or Firm*—Brooks & Kushman

[57] ABSTRACT

An apparatus and system for tensioning and securing the edges of a flexible sign panel to a frame or housing. Clip mechanisms formed from a pair of interlocking clip members are secured to the sign panel along its edges. The clip members include an insertion member and a mating generally "U" or "C"-shaped securing member. The clip mechanisms are hooked to the frame or housing by mating elongated ridge members. A clamping tool is used to mate the ridge member on the clip mechanisms with the ridge member on the frame members. Edge trim cap members clip onto the frame extensions and clip mechanisms to finish the edges of the sign assembly.

7 Claims, 10 Drawing Sheets

SHEET TENSIONING SYSTEM

TECHNICAL FIELD

This invention relates generally to sign assemblies with flexible panel members, and more particularly to improved tensioning systems for attaching the flexible panel members.

BACKGROUND OF THE INVENTION

Sign assemblies for advertising and promotional purposes are in common use today. Many of these sign assemblies use flexible sheets of material stretched across frames in order to provide the advertising or promotional messages. Many of these frames are positioned on housings which have internal illumination means, such as fluorescent lights or point light sources, for back lighting the stretched sheets of material.

Typically, the sign assemblies include a housing, flexible sheets of material, internal illumination sources, frames to support the flexible sign, and tensioning systems or mechanisms to stretch and secure the flexible signs to the frames or housing. The flexible panel members have been used on single-face and double-face sign assemblies which are typically positioned on walls, poles, or other structures.

An illuminated canopy sign assembly having a flexible face system is shown, for example, in U.S. Pat. No. 5,381,324. Other flexible face sign assemblies and tensioning systems therefor are shown, for example, in U.S. Pat. Nos. 4,937,961, 4,955,928, 5,127,177, 5,245,773, 5,245,774 and 5,301,447. These known systems have mechanisms which tension and secure flexible sheets of material on or across a frame or to a housing. These flexible sign members may include legends or graphics which present a message or image to the passing public, and the sign assemblies may be adapted to be backlighted by illumination sources in order to present a more aesthetic message to the public.

Many of these known sign assemblies provide effective tensioning and securing systems for flexible sheets of material, but many are difficult and time consuming to use, are difficult to adjust once installed in place, and/or are relatively expensive. There thus is a need for a simplified and more economical system for installing and providing flexible face sign assemblies.

It is an object of the present invention to provide an improved mechanism and system for installing and tensioning flexible face sign assemblies. It is another object of the present invention to provide a system for stretching a sheet of flexible material across a frame or housing which is more economical and easier to use than known systems.

It is a still further object of the present invention to provide a mechanism and system which can be easily adjusted where necessary to change or correct the tensioning of flexible face sign assemblies. It is still another object of the present invention to provide unique assembly mechanisms and tools for use in securing and stretching flexible face sign materials on frames.

These and other objects, features, benefits and advantages of the invention will become apparent from the following description of the invention when viewed in combination with the attached drawings and appended claims.

SUMMARY OF THE INVENTION

The present invention provides a sign assembly that includes a housing and frame with a front edge which defines an open sign area. A flexible sign member is positioned over the open area and stretched and secured along its edges.

Sets of interlocking clip members are positioned on the edges of the sheet of flexible sign material and then connected to the frame on the sign assembly. The edge of the sign material is positioned on one of the two clip members, folded over, and then the clip member is inserted in interlocking engagement into a second generally C-shaped clip member. The mated interlocking clip assembly is then hooked onto or connected to one of the longitudinal edges of the frame on the sign assembly housing. The sign material is then stretched across the open area of the housing and similarly secured in place along all of its edges. For this purpose, appropriate stretching tools can be utilized.

The two interlocking clip members can be snapped or interconnected together manually. If adjustment of the sign tension or placement of the interlocking clip members is necessary, the clip members can be separated by a common tool or instrument, such as a screwdriver, and be repositioned as necessary.

The present invention can be used with any type of sheet material which is stretched across a frame or housing, regardless of whether the sign assembly is illuminated or non-illuminated and whether the sign is single-face or double-face. The present invention also can be used regardless of the size of the sign, that is, regardless of the height or width of the frame or housing on which the sheet material is being installed.

Once the flexible sign material is satisfactorily secured in place and retained on the sign frame or housing, edge trim caps or cover members can be positioned along the edges. The cover members can be fastened or simply snapped on the elongated frame or housing edges to cover the interlocking clip members and provide a finished appearance to the sign assembly.

The present invention facilitates the installation and adjustment of flexible sign panels in an efficient and practical manner.

BEST MODES FOR CARRYING OUT THE INVENTION

Figure 1:
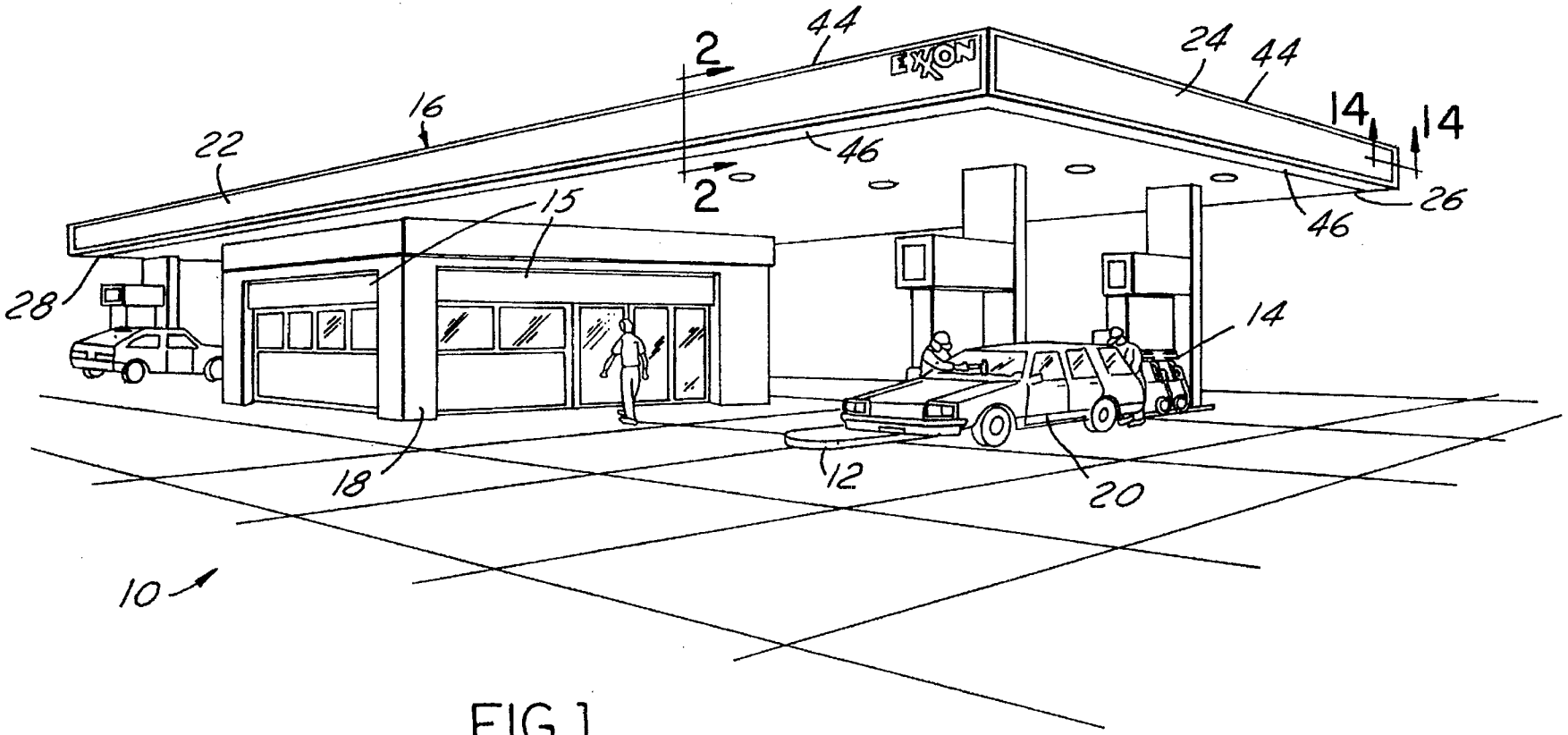
FIG. 1 illustrates a sign assembly in use at a service station.

FIG. 1 illustrates the use of the present invention in a canopy structure for a gasoline service station. The present invention is particularly suitable for use at gasoline service stations generally by the reference numeral 10 in FIG. 1. As shown, the service station 10 has one or more islands 12 with a number of gasoline pumps 14 positioned on it and the entire area is covered with a canopy structure 16. A service facility or building structure 18 is also provided under the canopy. The canopy 16 covers the area where the vehicles 20 are parked to purchase gasoline. The canopy protects the customers and vehicles from the weather elements and also provides a safe, well-illuminated area for use at night.

Although the present invention is shown and described with reference for use on a canopy structure, it is to be understood that the present inventive sign tensioning mechanism and system can be used for all varieties of sign assemblies and the like in which a flexible sheet of material is stretched and secured in place on a frame or housing. The sign assemblies can be used, for example, on walls, poles, business establishments, sports arenas, fast food restaurants, and the like. In this regard, FIG. 1 illustrates a pair of sign assemblies 15 positioned on the service station structure 18. The sign assemblies can also be positioned indoors or outdoors, as desired.

It is also understood that the present invention can be used with sign assemblies which are non-illuminated or illuminated (either internally or externally), and which can be one-sided or double-sided. For illuminated signs, the illumination can be of any standard or typical sources, whether fluorescent or point light sources, such as metal halide lamps or flood lamps. Further, it is understood that the sign assemblies in accordance with the present invention can have any conventional housing and be attached, secured, or built onto any type of fascia, wall, building, or other structure, without departing from the scope and purpose of the present invention.

The canopy structure 16 shown in FIG. 1 has fascia areas around its perimeter which are several feet in height and can be 10–20 or over 100 feet in length. These fascia areas are indicated by the numerals 22, 24, 26, and 28 in FIG. 1.

Figure 2:
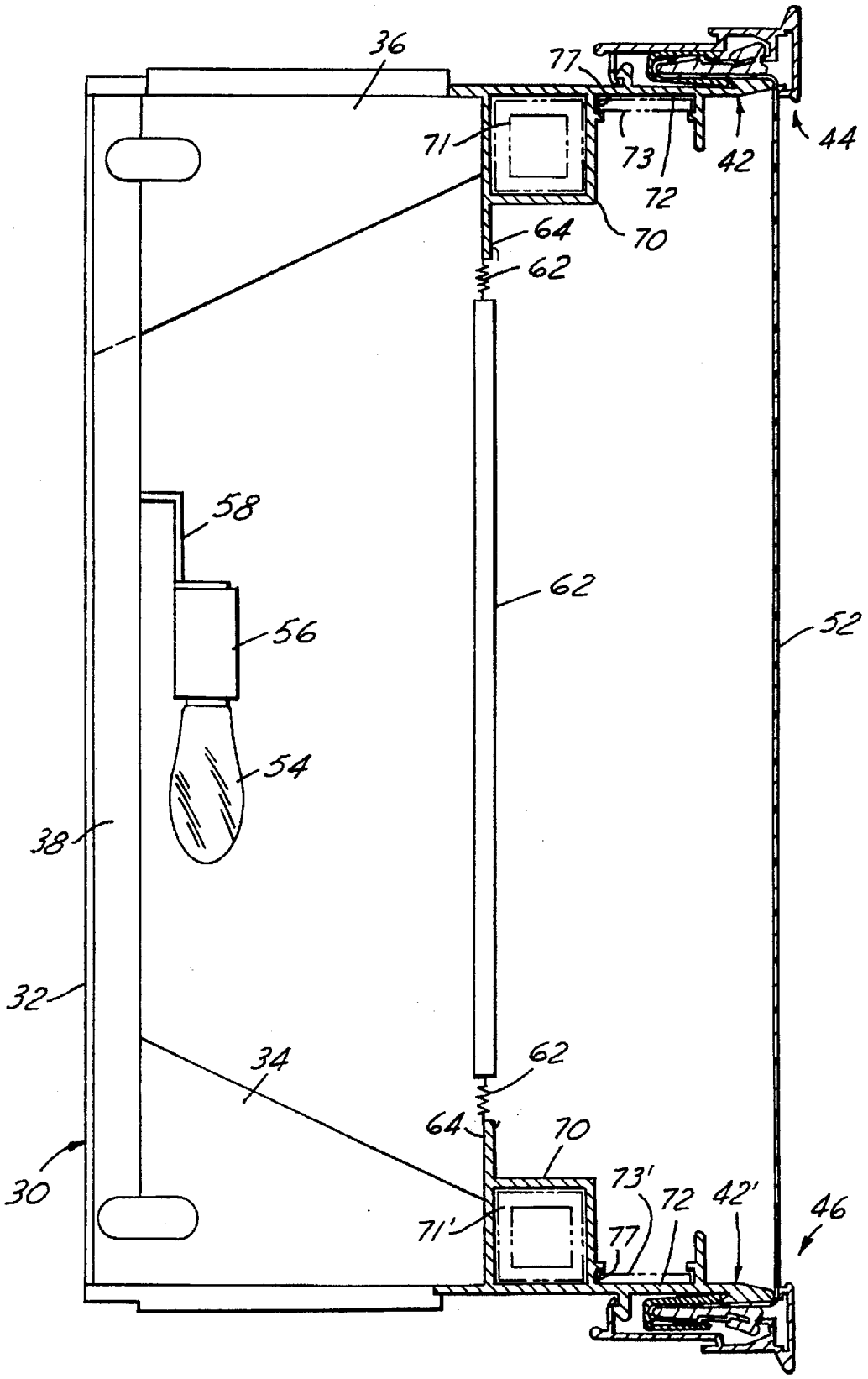
FIG. 2 is a cross-sectional view of the sign assembly as shown in FIG. 1 when taken in the direction of arrows 2—2 of FIG. 1.

The internal structure and configuration of a representative illuminated sign assembly is shown in FIG. 2. The sign assembly 30 has a rear panel member 32 and a plurality of support brackets 34 and 36 positioned along it. Vertical support members such as angle brackets 38 are attached to the backing member 32 and the support brackets 34 and 36 to provide an integral housing and sign structure. The support brackets 34 and 36 support elongated fascia edge frame extrusion members 42 and 42' at their outer ends. The frame extrusion members 42 and 42' have the same size and shape, but are mounted in opposite orientations, one above the other in the sign structure 30. The extrusions 42 and 42' provide the upper and lower edges, respectively, of the illuminated canopy fascia sign assembly and are represented by reference numerals 44 and 46, respectively. The frame extrusions 42 and 42' are made from extruded aluminum in the shapes shown in FIGS. 2–4 and are attached to the support brackets 34 and 36 in any conventional manner, such as by self-drilling fasteners (not shown).

Stretched over the front of the sign assembly 30 and held in place by the frame extrusions 42 and 42', as specified in more detail below, is a translucent, flexible film panel member 52. The panel 52 provides the facing of the fascias 22, 24, 26, and 28 of the canopy structure 16. The sign panel 52 preferably is a durable, flexible, translucent material, such as Panaflex 940 from the 3-M Company. That material consists of a polyester scrim embedded between two layers of vinyl. Of course, any other comparable sign panel material would be suitable.

The sign assembly 30 has a plurality of metal halide lights (or lamps) 54 positioned along the length of the rear panel member 32. The lights 54 are positioned in sockets 56 which are connected to the panel member 32 by brackets 58. Although metal halide lights are preferred, it is understood, as indicated above, that the illumination sources can be of any type conventional type, such as fluorescent lamps, and it is also possible for the sign assembly to not have any internal illumination at all. In this regard, a preferred form of an illuminated sign assembly using point light sources is disclosed in U.S. Pat. No. 5,381,324, which is assigned to the same assignee as the present application, the disclosure of which is hereby incorporated by reference. The '324 patent further depicts alternate embodiments of sign assemblies in which the present invention can be utilized. These alternate embodiments utilize different part members, such as different frame extrusions, diffuser members, and the like. Other embodiments of sign assemblies for use with the present invention are shown, for example, in co-pending U.S. patent application Ser. No. 321,045, filed on Oct. 5, 1994, entitled "illuminated Canopy System," and which is assigned to the same assignee as the present application. The disclosure of U.S. application Ser. No. 321,045, is also hereby incorporated herein by reference.

A light dispersion member 60 is positioned in the sign assembly 30 in order to distribute light from the light sources 54 uniformly on the inside surface of the sign panel 52. The light dispersion member 60 can be of any conventional type known in the illuminated sign field, and preferably is a pattern film member such as that described in U.S. Pat. No. 5,381,324. The pattern film member has a plurality of holes or openings on the face of the film, the openings being sized and arranged in a prespecified pattern designated to allow differing amounts of light to pass through the film at different areas.

The light dispersion member 60 can also consist of a metal, composite or laminated baffle or the like with a plurality of holes or openings, either uniformly spaced or spaced in a certain pattern to allow differing amounts of light to pass through at different areas.

The light dispersion member 60 can be connected by chains, springs, wires or the like from brackets 34 and 36 or separate brackets 64 in the sign assembly 30. Representative configurations of this type are shown, for example, in co-pending U.S. application Ser. No. 321,045, Filed Oct. 5, 1994. The light dispersion member 60 also could be a curved structure such as that shown in U.S. Pat. No. 5,381,324, which is connected to the rear panel member 32 and supported by a plastic support member.

Figure 3:
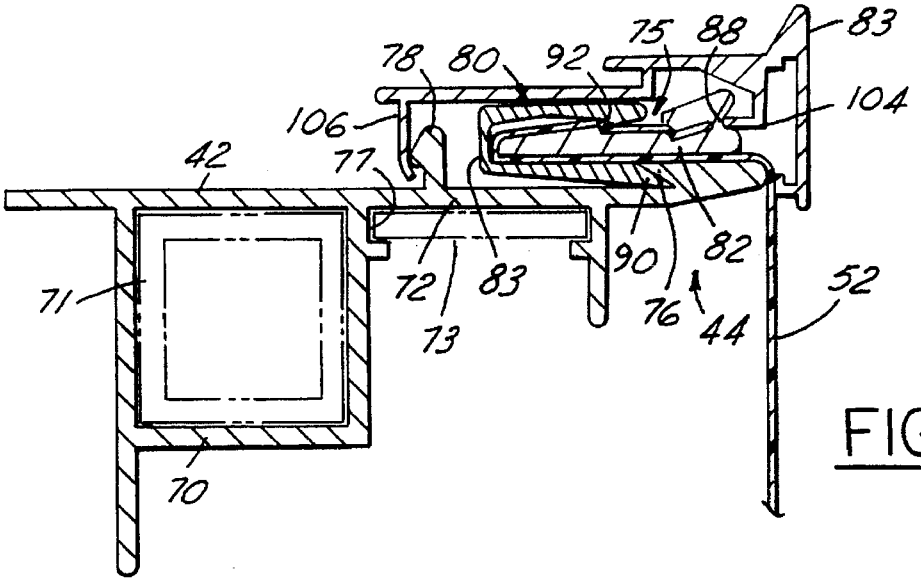
FIGS. 3 and 4 are enlarged views of the top and bottom front edges, respectively, of the illuminated sign assembly shown in FIG. 2.
Figure 4:
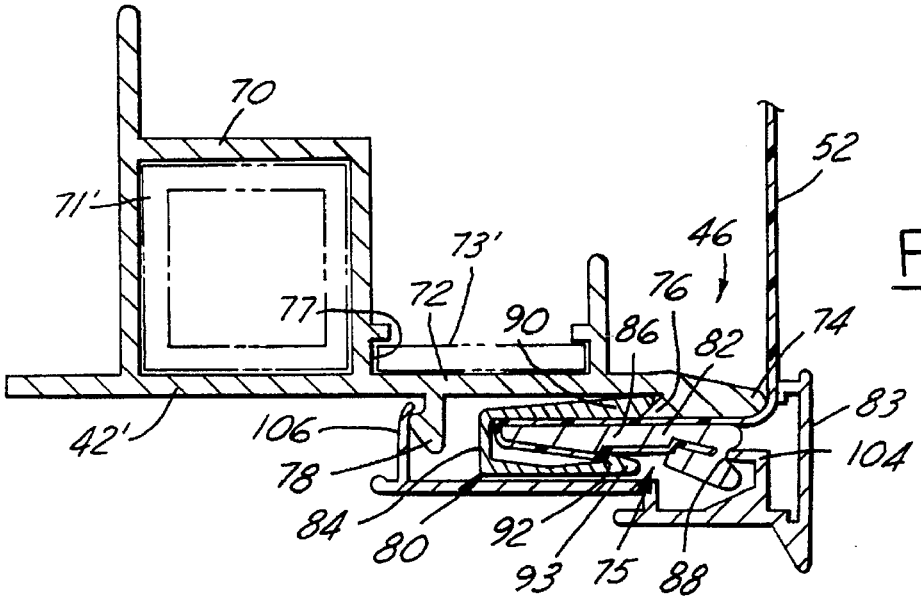

Enlarged views of the upper and lower edges of the sign assembly 30 are shown in FIGS. 3 and 4, respectively. The frame extrusion members 42 and 42' are preferably provided in the cross-sectional sizes and shapes shown in FIGS. 3 and 4. The extrusions have a box-like tubular portion 70 for increased strength and rigidity, as well as a protruding cantilever flange 72 having a rounded front ridge or edge member 74. Flange member 72 has a rearwardly facing hook member 76 and an upstanding hooked rib member 78. The hook member 76 is adapted to interact and mate with interlocking edge tensioning mechanism 80 which is described in more detail below. The rib member 78 is adapted to mate with and help secure trim cap members 83 to the edges of the sign assembly as shown, and as described in more detail below.

With long fascia members or mounting surfaces, it may be necessary to utilize several lengths of frame extrusion members 42 and 42'. Adjacent frame extrusion members can be joined together, for example, by the use of tubular splice members 71 and 71', or flat splice members 73 and 73' (as shown in FIGS. 2–4). The tubular splice members 71 and 71' are adapted to fit within adjoining tubular portions 70, while flat splice members 73 and 73' are adapted to fit within adjoining channels 77 and 77'. Channels 77 and 77' can also be utilized to hold L-shaped corner bracket members for connecting together adjoining frame extrusion members in the corners of the rectangularly-shaped sign assembly.

Figure 4A:
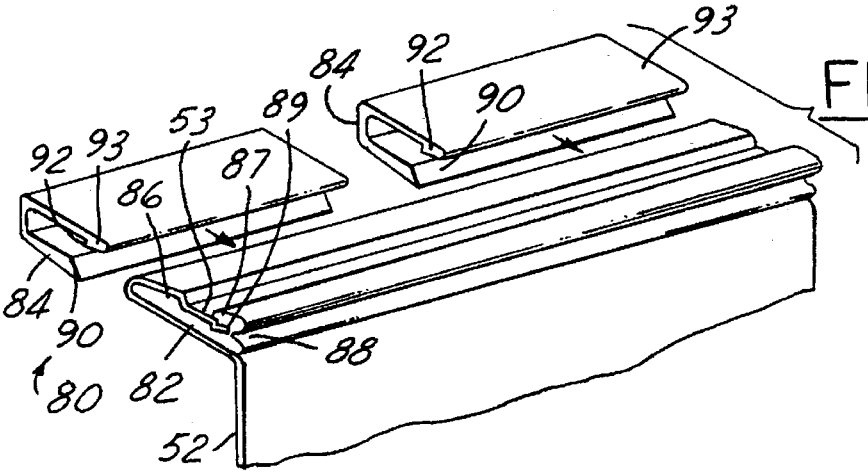
FIG. 4A depicts the unique interlocking clip members in accordance with the present invention.

The interlocking tensioning mechanism 80 is shown in FIGS. 3 and 4 and in more detail in FIG. 4A. The mechanism 80 has an insertion clip member 82 and a generally "U" or "C"-shaped cover clip member 84. The edge 53 of the flexible sheet member 52 is positioned and folded around the insertion clip member 82 as shown. Insertion member 82 has a first elongated hooked ridge member 86, a second elongated ridge member 87, an elongated groove 88, and a pocket or recess 89.

The C-shaped mating clip member 84 has an elongated hook member 90 along one edge which is adapted to mate with hook member 76 on the frame extrusion members 42 and 42', as shown in FIGS. 3 and 4. The mating clip member 84 has an elongated hooked ridge member 92 adjacent its opposite end 93 for mating and interlocking with complementary ridge member 86 on the insertion clip member 82.

As shown in FIG. 4A in an exploded view, the interlocking assembly 80 is attached to the edge 53 of the flexible sheet material or panel member 52. The edge or end 53 of the panel member 52 is wrapped around insertion clip member 82 and then the member 82 is forcibly inserted into the securing C-shaped clip member 84. The edge 53 of the panel member 52 is positioned in pocket or recess 89 in insertion member 82. The securing clip member 84 is forced over the insertion clip member 82 until elongated ridge member 92 overlaps and mates with elongated ridge member 86. This interlocking relationship is shown in FIGS. 3 and 4.

The securing C-shaped clip member 84 can be positioned on insertion clip member 82 over the end of the panel member 52 manually, or in any conventional manner. If necessary, a clamping tool or mechanism, such as a pair of pliers, can be used to ensure that the ridges 86 and 92 overlap and thus that the two clip members 82 and 84 are interlocked together (as shown in FIGS. 2–4).

Insertion clip member 82 is preferably on the order of 15–18 inches in length and made of extruded aluminum. The C-shaped securing clip member 84 is preferably on the order of 4–6 inches long and made from extruded aluminum or an extruded plastic material. In this regard, other comparable or equivalent materials can be used for the clip members 82 and 84, so long as they have the durability and strength to meet the objects and purposes of the present invention. Also, as shown in FIG. 4A, two or three C-shaped clip members 84 are provided for each insertion clip member 82 along the edges of the sign material. Also, in installing the flexible panel member 52 with use of the interlocking tension assembly mechanism 80, it is preferred to position a plurality of interlocking mechanisms 80 adjacent one another along the length of all of the edges of the panel member 52. In this manner, the panel member can be stretched evenly and uniformly along each of the edges thereby presenting a smooth and uniform stretched surface.

Figure 9:
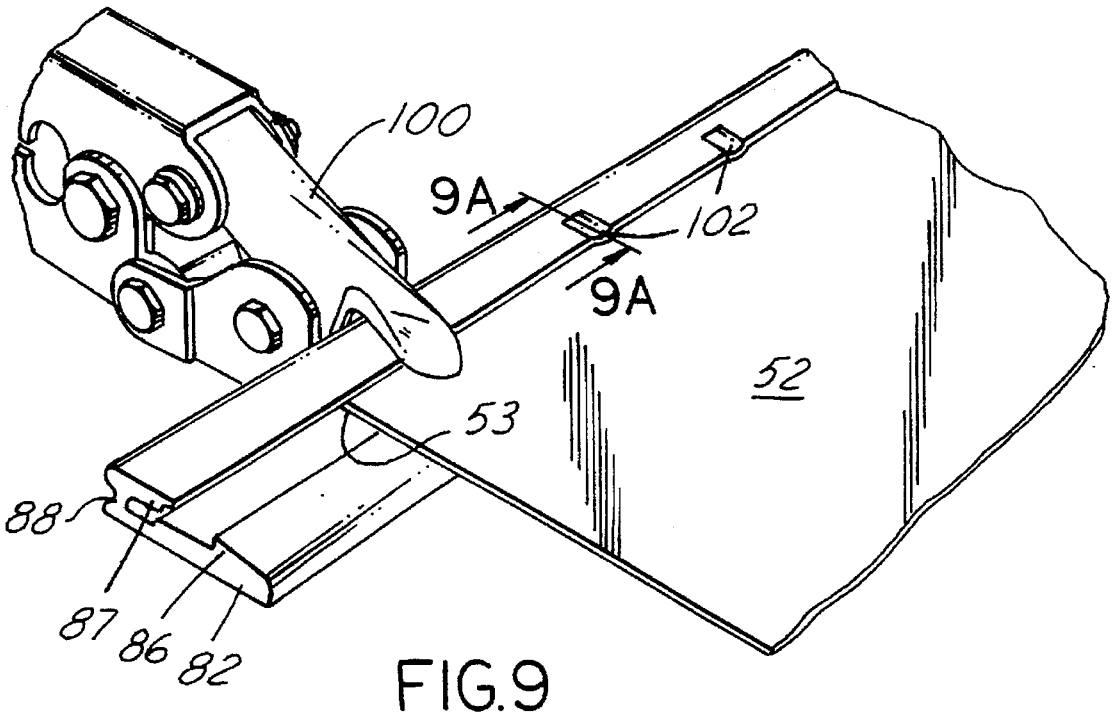
FIGS. 9 and 9A illustrate an optional crimping procedure which can be used in accordance with the present invention, with FIG. 9A being a cross-sectional view taken along lines 9A—9A in FIG. 9 and in the direction of the arrows.
Figure 9A:
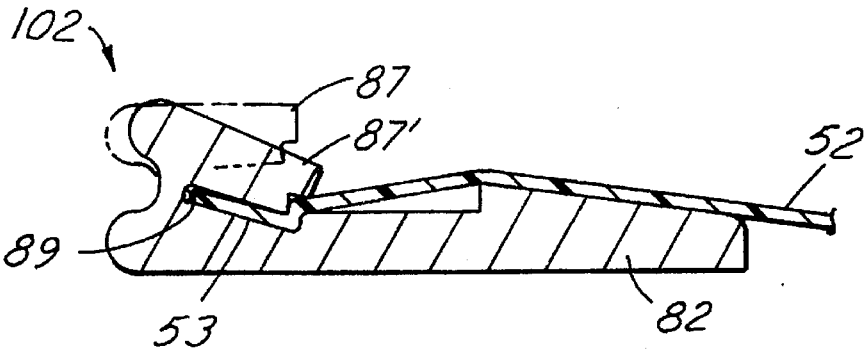
Figure 10:
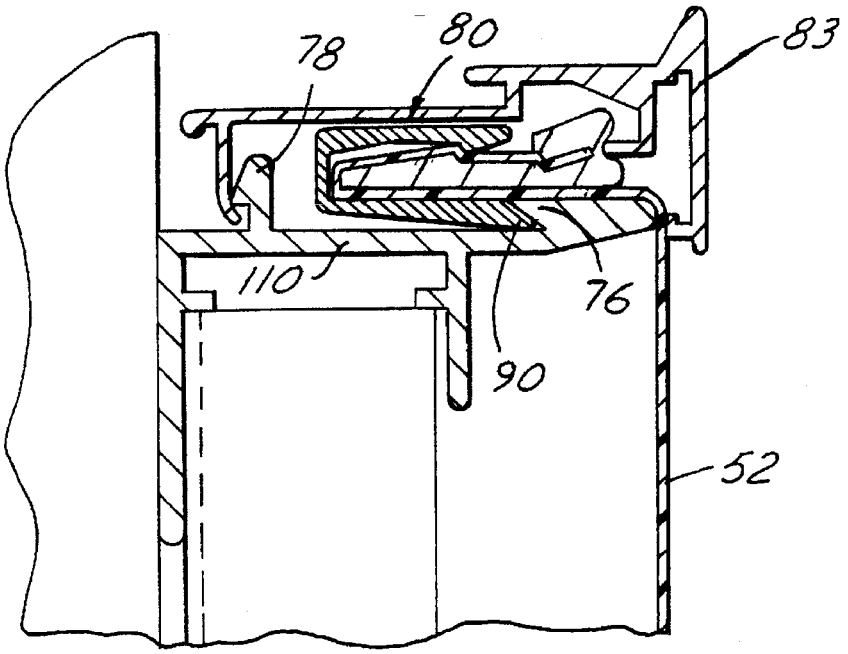
FIGS. 10 and 11 are enlarged views of the top and bottom edges, respectively, of a sign assembly utilizing another embodiment of the present invention.

If desired, it is also possible to crimp the insertion clip member 82 along elongated ridge member 87 in order to positively connect it to the edge 53 of the panel member 52 (and to insure that edge 53 remains in pocket or recess 89). This optional procedure is shown in FIG. 9. A crimping tool 100 can be used to interlock the clip member 82 to the edge 53 of panel member 52 by forming interlocking connections 102 along the length of the ridge member 87 on the clip member 82. As shown in FIG. 9A, ridge member 87 is displaced to position 87' by the crimping procedure and positively secures and holds edge 53 in place.

Once the flexible sign material 52 is connected to the interlocking clip mechanisms 80 and the mechanism 80 are secured in place on the ends of frame extrusions 42 and 42' (as explained in more detail below), trim cap members 83 are positioned in place. This is shown in FIGS. 3, 4, 5 and 6. The trim cap members 83 have an elongated ridge or flange member 104 which is adapted to fit within groove 88 in insertion clip member 82. The opposite ends of the trim cap members 83 have elongated flange members 106 which snap on and thus interlock and interconnect with the upstanding ridge member 78 on the frame extrusions 42 and 42'.

Figure 5:
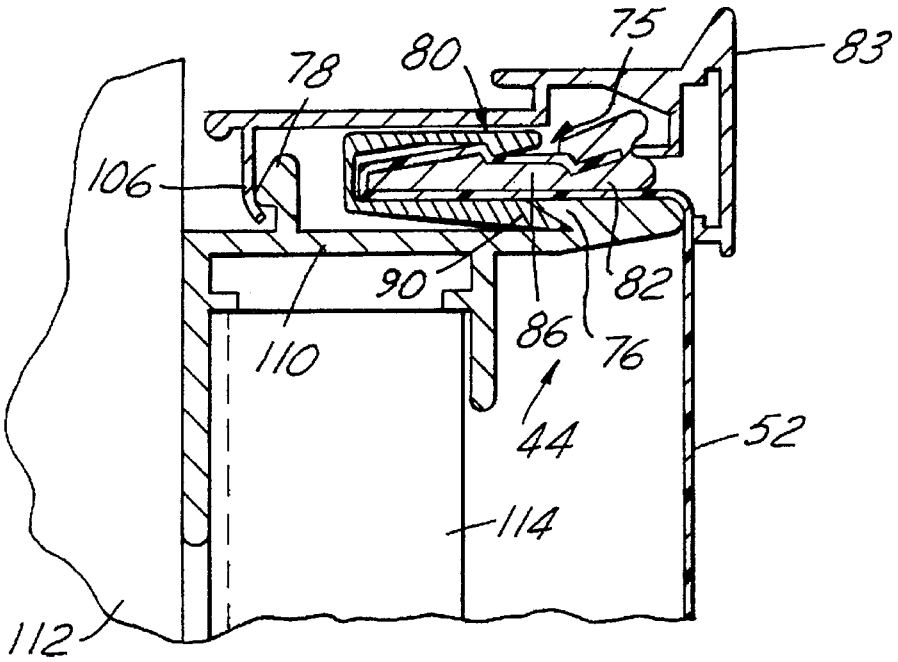
FIGS. 5 and 6 are enlarged views of the top and bottom front edges, respectively, of an alternate non-illuminated embodiment of a sign assembly utilizing the present invention.
Figure 6:
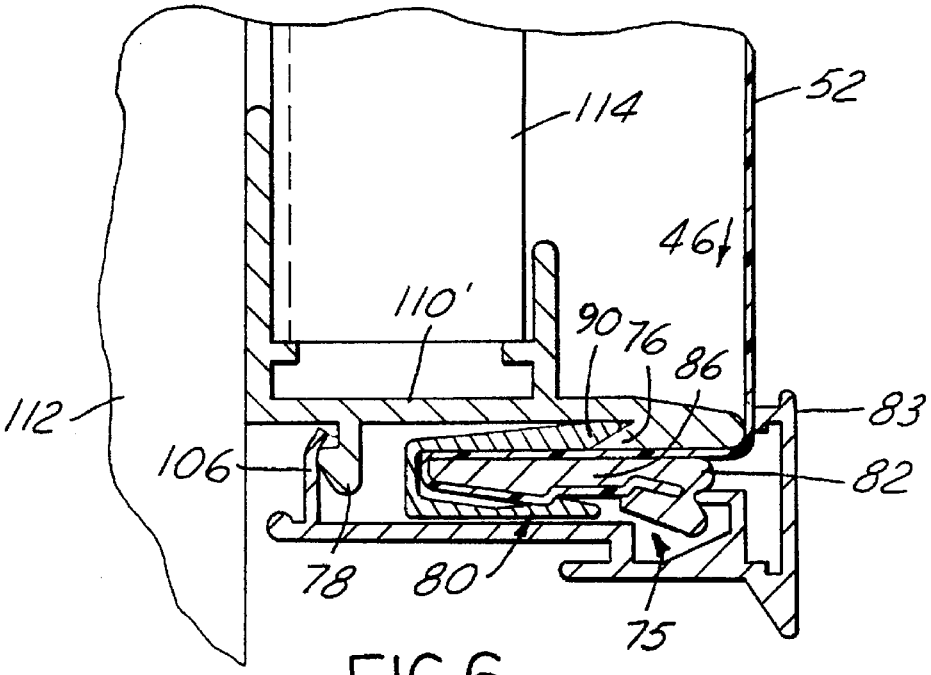

FIGS. 5 and 6 illustrate an alternate embodiment of the present invention in which the sign assembly is particularly used for a non-illuminated sign structure. In the embodiment shown in FIGS. 5 and 6, the frame extrusion members 110 and 110' do not extend as far from the facia or binding structure 112 and do not contain a tubular or box-type structure, such as that shown by reference numeral 70 in FIGS. 3 and 4. In this regard, the additional strength provided by a tubular box-type structure is not necessary for a non-illuminated sign structure since vertical support members 114 can be positioned closer together along the length of the sign assembly. (With illuminated signs, the vertical frame support members 38 are positioned further apart in order to provide sufficient space for the illumination sources, and thus stronger frame extrusions 42, 42' are required.) The support members 114 can be U-shaped channel members, box-type tubular members, angle irons, or the like.

Except for the size and shape of the elongated frame extrusions which are positioned on the edges of the sign assemblies, the stretching and tensioning mechanism and system used for the flexible front panel member 52 of the sign assemblies shown in FIGS. 3–4 and 5–6 are the same. In this regard, the interlocking edge tensioning mechanism 80, insertion clip member 82, C-shaped securing clip member 84, and edge or trim cap member 83 in FIGS. 5–6 are the same as those described above with reference to FIGS. 3–4 and operate in the same manner.

Figure 7:
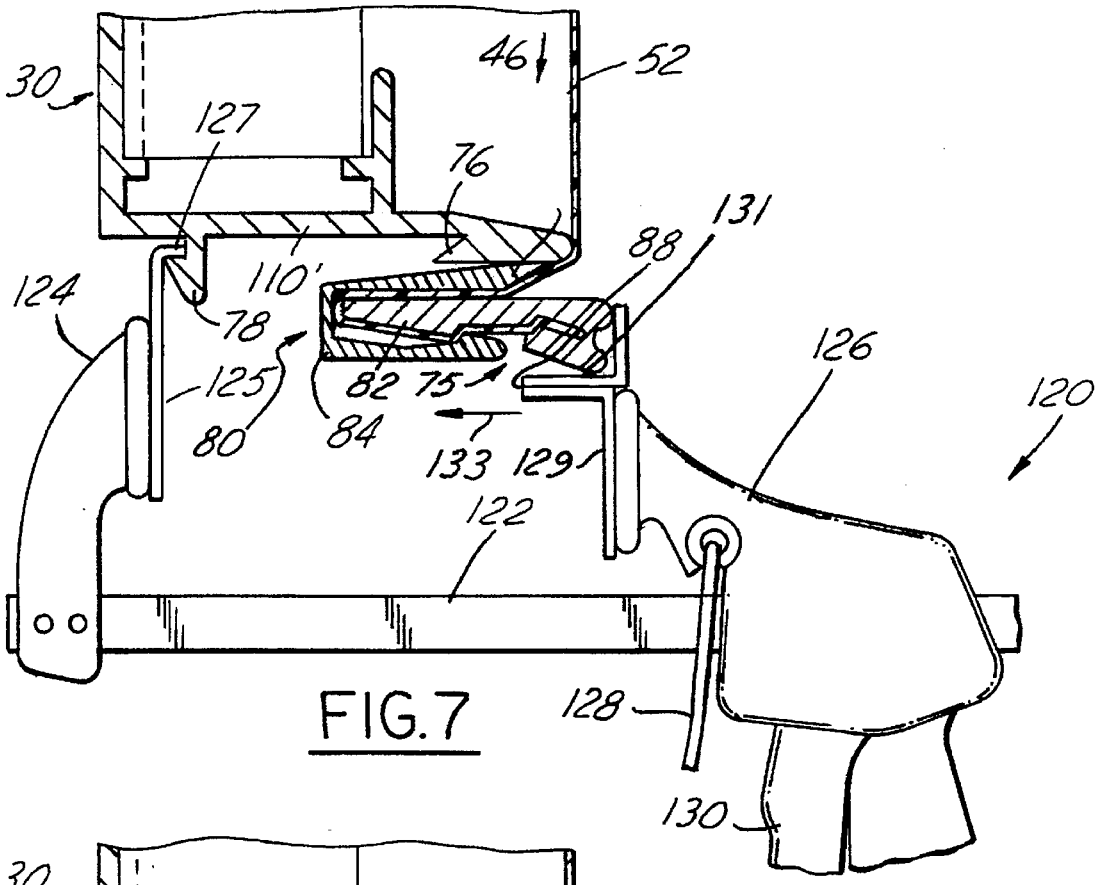
FIGS. 7 and 8 illustrate a process for tensioning of the flexible sheet material on the sign assembly housing or frame, and installation of the interlocking clip members.
Figure 8:
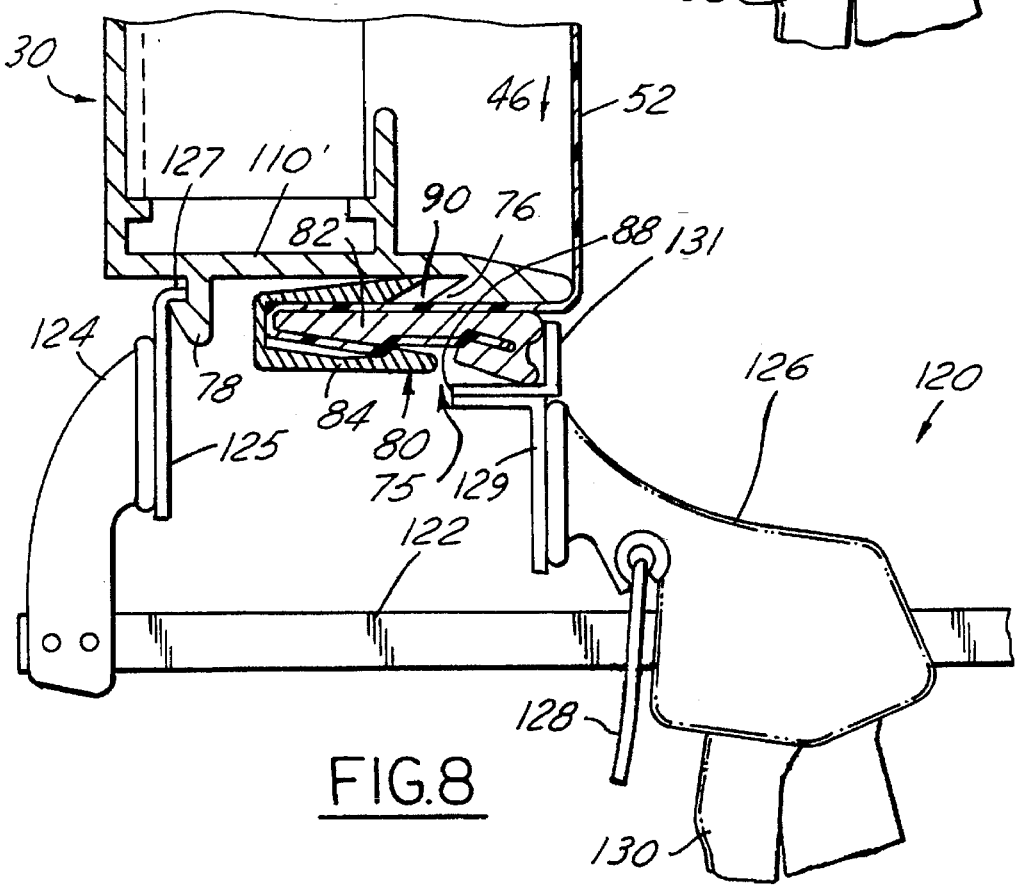

The stretching of the front panel member 52 and assembly of the edge tensioning mechanism 80 on the frame extrusions of the sign assembly, is shown in FIGS. 7 and 8. For this purpose, a clamp-like tool 120 is provided. The tool 120 has an elongated metal rail or rod 122 with a first clamping member 124 fixedly secured to one end thereof. A second clamping member 126 is slidingly engaged to the rail or rod 122 and adapted to be secured to or released from rod 122 as desired by trigger member 128. The clamping member 120 is held manually by a worker installing the sign panel by means of handle member 130.

First clamping member 124 has plate member 125 attached thereto, plate member 125 having a ridged or flanged end 127 adapted to mate with hooked ridge 78 on extrusion member 110'. Also, second clamping member 126 has plate 129 secured thereto, plate 129 having elongated ridge or flange member 131 extending therefrom and adapted to mate with the end of insertion clip member 82.

The installation process for tensioning the sign panel member 52 and installing panel member 52 on the sign assembly is described as follows. Initially, one end of the sign panel is installed along one of the side edges of the sign assembly 30. Typically, most sign assemblies are elongated or rectangular in shape—such as canopy fascia members 22, 24, 26 and 28 as shown in FIG. 1—and the sign panels are installed by first connecting or attaching one of the shorter ends to the housing or frame and then proceeding to extend and stretch the sign panel member along the rest of the length of the sign assembly causing it to be stretched and held in place under tension. A process for installing the smaller ends of the sign panel to the frame is described below with reference to FIG. 19.

Once a first shorter end of the sign panel 52 is attached, the upper edge 46 of the sign panel is positioned on and progressively attached to the housing or elongated upper frame member. As shown in FIGS. 3, 4A and 5, the upper edge of the sign panel is first secured to a series of interlocking clip mechanisms 80 and the mechanisms 80 are then assembled in place on upper frame extrusion member 110 (or 42 as shown in FIG. 3). In this procedure, the hooked end 90 of C-shaped clip member 84 is secured over hooked ridge member 76 on the frame extrusion 110. Subsequently, along the lower edge of the sign panel 52, additional interlocking clip assemblies 80 are progressively installed. In this regard, the interlocking clip mechanisms 80 are installed on the lower edge of the sign panel member 52 such that hooked ridge 90 cannot be positioned in interlocking engagement with ridge member 72 on frame extrusion member 110'. This situation is illustrated in FIG. 7. At this point, clamping tool 120 is positioned in a manner shown in FIG. 7, that is with ridge member 127 hooked behind ridge member 78 and with clip mechanism 80 resting on flange member 131. Thereafter, with movement of the clamping member 126 in the direction of arrow 133 in FIG. 7, the interlocking clip mechanism 80 is moved by tool 120 until the ridge member 90 passes ridge member 76 and snaps into interlocking engagement, as shown in FIG. 8. At this point, the front sign panel member 52 is tightly stretched and tensioned in place on the sign assembly 30 between the upper and lower edges 44 and 46.

Once the upper surface edges of the sign panel member are secured in place, trim cap members 83 are snapped in place along the edges of the sign assembly. The final assembled configurations of the edges of the sign assemblies are shown in FIGS. 3 and 4 (for an illuminated sign assembly) and in FIG. 5 and 6 (for a non-illuminated sign assembly). The installation of the flexible face material on a sign assembly can be accomplished in a quick and efficient manner in accordance with the present invention. The installation procedure can be accomplished simply by two persons, one attending to the top or upper edge of the panel member, and the other person attending to the lower or bottom edge. Once the initial edge or end of the sign panel member is secured in place, the person attending to the top edge can proceed along the top edge installing the interlocking clip mechanisms 80 and locking them in place on the upper frame extrusions as described above. The person attending to the lower edge then proceeds slightly behind the person attending to the upper edge and installs the interlocking clip mechanisms 80 along the lower edge of the sign panel and locks them in place on the lower frame extrusion with the clamping tool 120.

It is understood, that any type of clamping tool can be utilized in accordance with the present invention to position the interlocking clip mechanisms 80 on the lower frame extrusions 42' and 110'. Any conventional type of clamping or gripping instrument or tool could be utilized.

Also, if it is necessary to adjust the tension along the edge of the sign panel member 52 at any time, this can be done in a quick and efficient manner. The interlocking extrusion mechanism 80 can be easily disengaged from the edge of the panel 52 by simply inserting and twisting a screw driver, lever or the like, in gap 75 in the assembly 80. Gap 75 is shown in FIGS. 3, 4, 5, 6, 7 and 8. Once the clip members 82 and 84 are disengaged, the insertion clip member 82 can be repositioned as desired and reinserted and relocked in place in the mating C-shape clip member 84. The repositioned clip mechanism 80 can then be resecured in place on the frame mechanism by the clamping tool 120 or the like.

Figure 19:
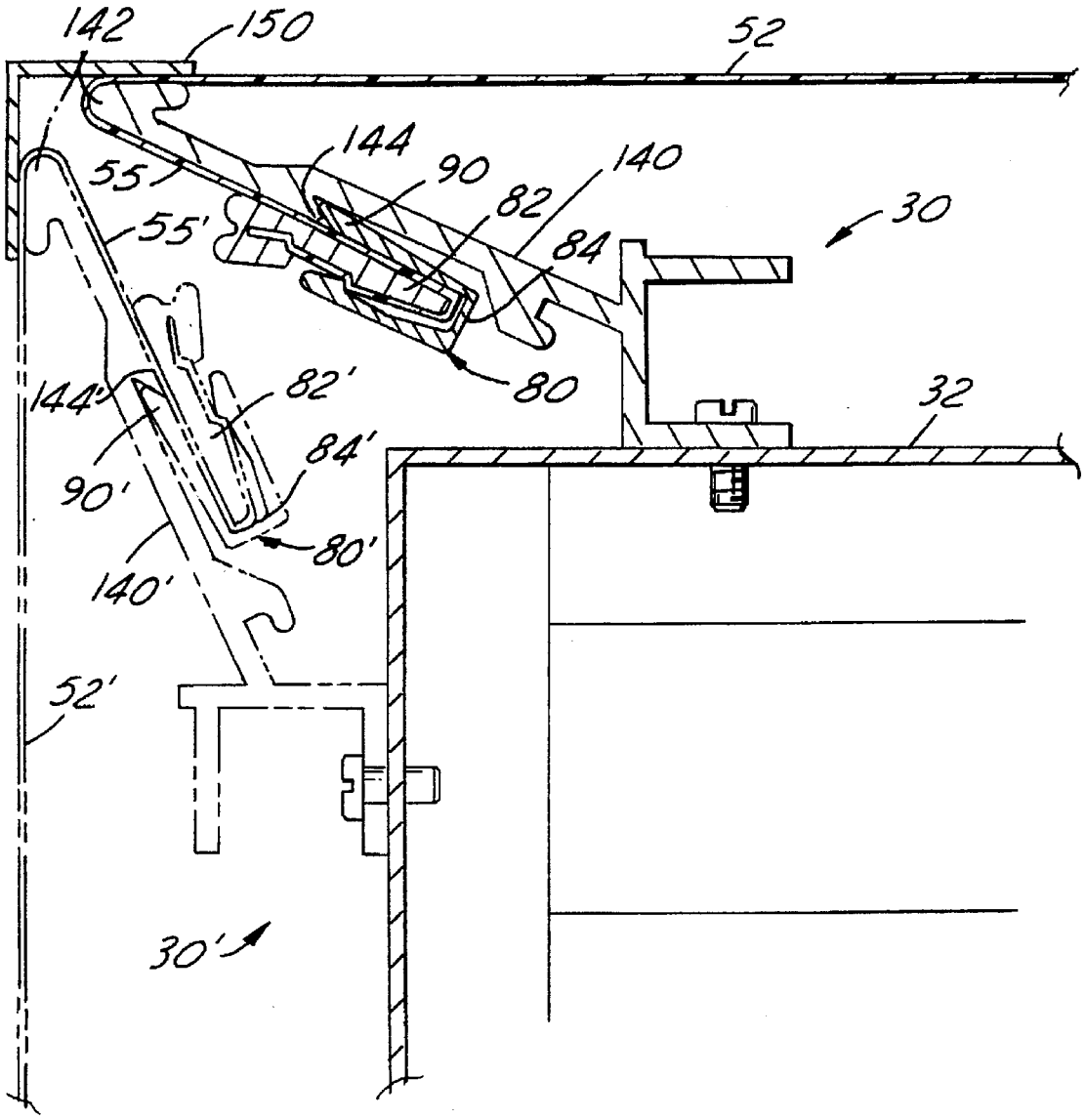
FIG. 19 is a representative cross-sectional view illustrating the sign panel tensioning system which can be utilized at the ends or corners of a sign assembly, the cross-section being taken along lines 19—19 in FIG. 1 and in the direction of the arrows.

The system for installing the sign panel member 52 at the shorter ends of a rectangular sign assembly 30 is shown in FIG. 19. A corner frame extrusion member 140 is attached to the rear panel member 32 of the sign assembly and extends at an angle toward the outer corner of the sign assembly. The end edge 55 of the stretchable panel member 52 is stretched around the end 142 of the extrusion member 140 and held in place by a series of interlocking edge clip mechanisms 80. Mechanisms 80 are the same as those described above and include insertion clip members 82 and mating C-shaped clip members 84. Elongated ridges 90 on the mechanisms 80 interlock with elongated ridge member 144 on the end extrusion frame 140.

As indicated above, an initial end of the sign panel member 52 is first installed in place on the sign assembly 30. A plurality of clip mechanisms 80 can be used for this purpose, although the initial end could be secured in place by any conventional means. Then, both the upper and lower elongated edges of the sign panel member are stretched lengthwise and widthwide and secured in place under tension by a plurality of interlocking clip mechanisms 80, as indicated above. At the opposite end, the sign panel member 52 is also held in place by a plurality of clip mechanisms 80, similar to that shown in FIG. 19.

For a canopy fascia system, it is often necessary to abut two sign assemblies together at a corner of the canopy. In this regard, a second sign assembly 30' is shown in phantom in FIG. 19 and in abutting relationship with a first installed sign assembly 30. The installation of the sign assembly 30' is the same as that described above with reference to sign assembly 30. The sign panel 52' is attached at an initial end 55' and then stretched vertically and horizontally along the sign assembly frame until the opposite end is reached where a similar ending procedure is performed.

To finish off and complete the corner installation of a canopy fascia system, corner trim member 150 is typically provided. Member 150 is a bent piece of metal, or an extruded rigid angle member, and is attached to the ends of adjacent edge trim cap members in order to hold it in place.

Figure 11:
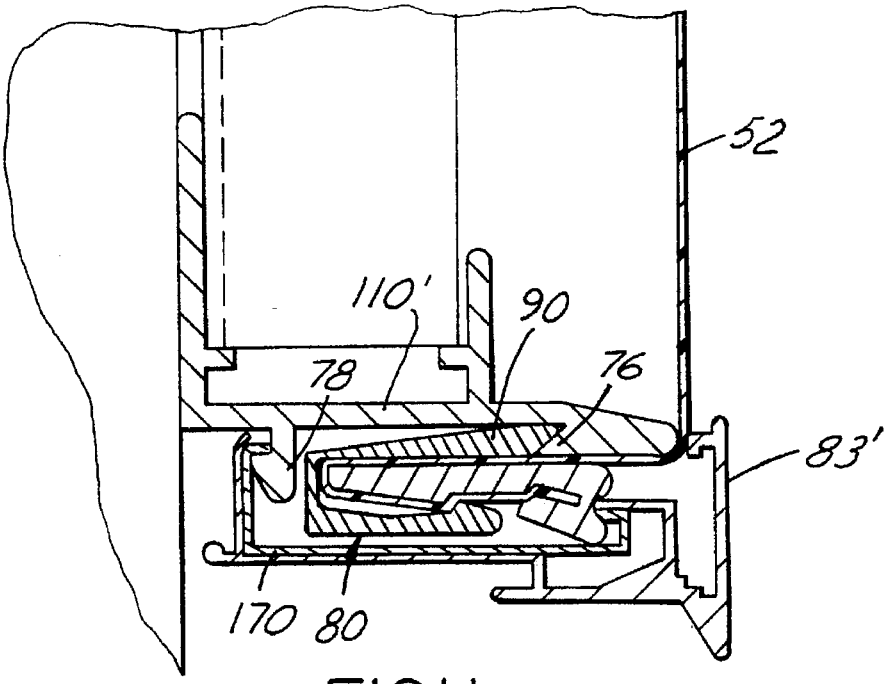
Figure 12:
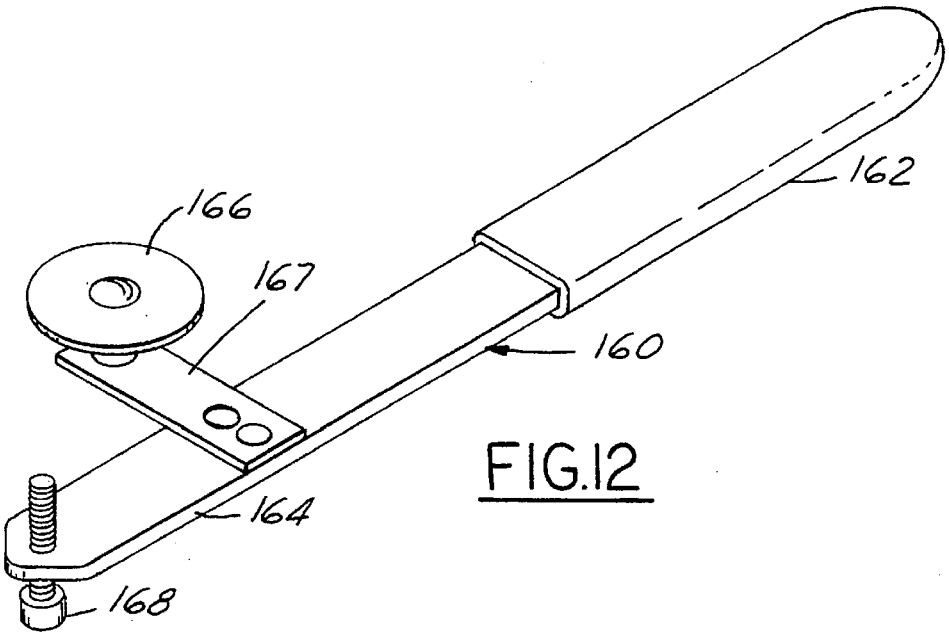
FIGS. 12–18 illustrate tools for use in installing the embodiment shown in FIGS. 10 and 11.
Figure 13:
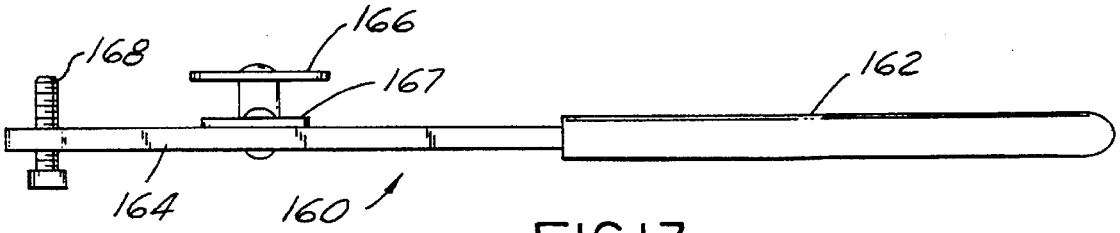
Figure 14:
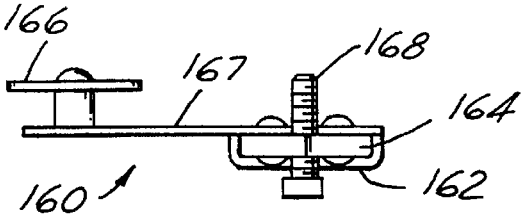
Figure 15:
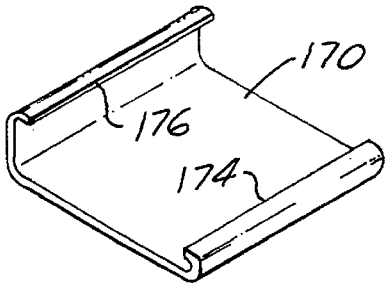
Figure 16:
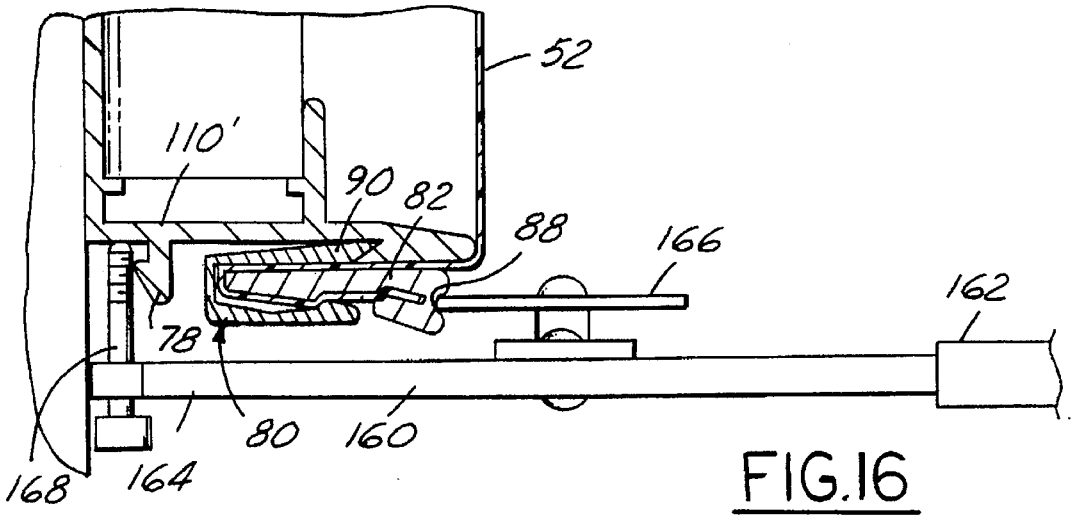
Figure 17:
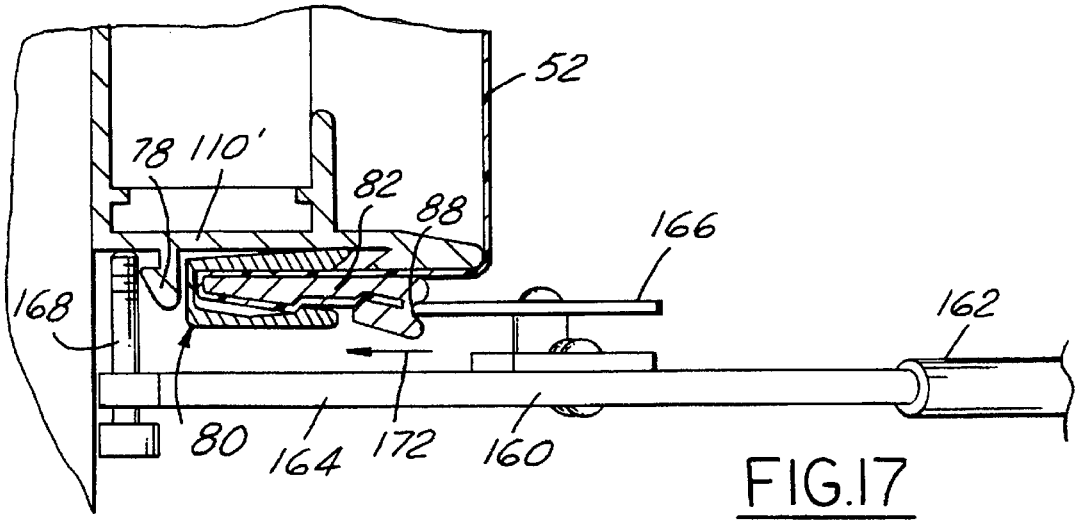
Figure 18:
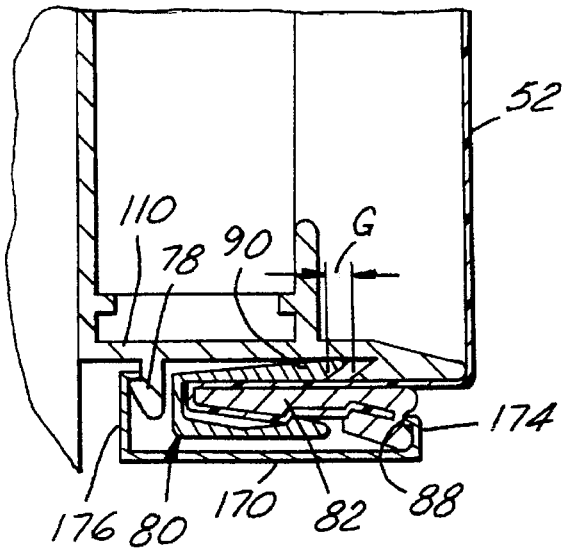

In order to install the ends of the sign panel member 52 when there is insufficient space to utilize a clamping member such as member 120 shown in FIGS. 7 and 8, it is possible to utilize a lever member 160 as shown in FIGS. 12–14 of the drawings. Also, if additional stretching is necessary on the sign panel 52 and it is not possible or practical to reposition the clip mechanisms 80 along the edges of the sign assembly, particularly the lower edge, then an alternate embodiment as shown in FIGS. 10–18 can be utilized. In general, in this embodiment, a generally C-shaped clip member 170, shown in FIG. 15, is used to position and securely hold clip mechanism 80 in a position as shown in FIGS. 11 and 18. In this position, the ridge member 90 of the clip mechanism 80 is not interlocked or engaged with ridge member 76 of the frame extrusion 110'.

The lever member 160 has a handle 162 and an elongated opposite end 164 with a circular plate 166 positioned on transverse arm member 167 and an adjustable stop member 168. In this regard, stop member 168 can be a screw or fastener threadedly received in the end of the member 164. The operation of the lever 160 is shown in FIGS. 16 and 17. The edge of disc 166 is adapted to be positioned in channel 88 on insertion clip member 82, and the stop member 168 is adapted to be positioned behind upstanding ridge member 78 of frame extrusion 110'. As lever member 160 is rotated relative to the frame extrusion 110, the distance between the disc 166 and stop member 168 is reduced which in turn displaces the interlocking clip mechanism 80 in the direction shown by arrow 172 in FIG. 17. When the flexible sign panel material 52 is adequately tensioned, clip member 170 is installed and crimped in position as shown in FIG. 18 (and also in FIG. 11). In this regard, first elongated end 174 of the clip member 170 is positioned in groove 88 in the insertion member 82 and the opposite elongated ridge member 176 of the clip member 170 is interlocked with upstanding ridge member 78. As shown in FIG. 18, gap "G" is created between members 90 and 76.

Once the clip members 170 are positioned in place, the trim edge cap members 83' are installed in place as shown in FIG. 11. As shown, cap members 83' are custom formed in order to snap into place on extrusion members 110 over clip member 170. (The trim edge cap members on the upper elongated sign assembly edge are the same as and are snapped in place in the same manner as described above with reference to FIGS. 3 and 5.)

It is also possible to utilize the installation procedure as described in FIGS. 10–18 for stretching and tensioning the sign panel member along the length of the sign assembly 30. However, it is preferred to utilize the installation procedure and method as described above with reference to FIGS. 3–8.

Although particular embodiments of the present invention have been illustrated in the accompanying drawings and described in the foregoing detailed description, it is to be understood that the present invention is not to be limited to just the embodiments disclosed, but that they are capable of numerous rearrangements, modifications and substitutions without departing from the scope of the claims hereafter.

It is claimed:

1. A device for securing flexible sheet materials to a frame member, said frame member having a first elongated hook member, said device comprising:

a first clip member, said first clip member being elongated and having a first elongated rib member thereon and an elongated recess means therein;

a second clip member, said second clip member having a channel for entry of said first clip member therein, a second elongated rib member positioned to mate with said first rib member, and a second elongated hook member for mating with said first elongated hook member;

an end cap trim member;

wherein said first and second clip members are adapted to be interlocked together by means of said first and second elongated rib members and to securely hold an edge of a flexible sheet material therebetween, and said second clip member is adapted to matingly interlock with said frame members by means of said first and second elongated hook members; and wherein said frame member has a third elongated hook member thereon and said end cap trim member is adapted to be secured to said third elongated hook member and said recess means.

2. A system for stretching a flexible sheet of material comprising:

a housing, a frame on said housing, said frame having at least a first frame member and a second frame member spaced apart from each other, said first frame member having a first elongated hook member and a first elongated flange member and said second frame member having a second elongated hook member and a second elongated flange member, a flexible sheet of material for being positioned on said housing and stretched between said first and second frame members, a plurality of interlocking clip devices positioned along the edges of said sheet of material and connecting said sheet of material to said frame members, each of said clip devices having a first elongated clip member with a first elongated rib member thereon, and a second elongated clip member with a second elongated rib thereon, said first clip members each having an elongated groove therein, said second clip members each having a channel means for positioning therein of said first clip member, and a third elongated hook member thereon, first and second edge trim cap members for positioning along said housing, wherein said sheet of material is releasably secured in said clip devices by said interlocking first and second rib members, and said clip devices are releasably secured to said frame members by said interlocking third elongated hook members with said first hook member on said first frame member and said second hook member on said second frame member, and wherein said cap members are secured to said first and second flange members and said grooves in said first clip members.

3. The system as set forth in claim 2 wherein said second clip members are generally U-shaped and said first clip members have relative flat elongated portions which fit within and are interlocked in said channel means.

4. The system as set forth in claim 2 wherein each of said clip devices comprise at least two second clip members for each first clip member.

5. The system as set forth in claim 2 wherein the edges of said sheet of material are initially secured to said first clip members.

6. The system as set forth in claim 5 wherein said edges are secured by crimping.

7. A system for stretching a flexible sheet of material comprising:

a housing, a frame on said housing, said frame having at least a first frame member and a second frame member spaced apart from each other, said first frame member having a first elongated hook member and said second frame member having a second elongated hook member, a flexible sheet of material for being positioned on said housing and stretched between said first and second frame members, a plurality of interlocking clip devices positioned along the edges of said sheet of material and connecting said sheet of material to said frame members, each of said clip devices having a first elongated clip member with a first elongated rib member thereon, and a second elongated clip member with a second elongated rib thereon, said second clip members each having a channel means for positioning therein of said first clip member, and a third elongated hook member thereon, wherein said sheet of material is releasably secured in said clip device by said interlocking first and second rib members, and said clip devices are releasably secured to said frame members by said interlocking third elongated hook members with said first hook member on said first frame member and said second hook member on said second frame member, and a C-shaped clip member for securing said clip devices to said second frame member.

* * * * *